US005662334A

United States Patent [19]

Leinen, Sr. et al.

[11] Patent Number: 5,662,334

[45] Date of Patent: Sep. 2, 1997

[54] INSTANT RESPONSE BULL'S -EYE TARGET SYSTEM

[76] Inventors: James A. Leinen, Sr.; Carolyn Leinen; James A. Leinen, Jr.; Tammy M. Leinen, all of N5392 County Rd. J, Tigerton, Wis. 54486

[21] Appl. No.: 654,706

[22] Filed: May 29, 1996

[51] Int. Cl.[6] ..... F41J 5/04

[52] U.S. Cl. ..... 273/374

[58] Field of Search ..... 273/371, 374, 273/375, 392

[56] References Cited

U.S. PATENT DOCUMENTS

| | | | |
|---|---|---|---|
| 1,005,008 | 10/1911 | Ellis | 273/374 |
| 1,096,292 | 5/1914 | Ellis | 273/374 |
| 2,171,295 | 8/1939 | Shultz | 273/374 |
| 4,614,345 | 9/1986 | Doughty | 273/392 X |
| 4,726,593 | 2/1988 | Wade | 273/407 X |
| 4,917,388 | 4/1990 | Marquardt | 273/407 X |
| 5,533,732 | 7/1996 | Leinen, Sr. et al. | 273/375 |

*Primary Examiner*—William H. Grieb

[57] ABSTRACT

An instant response bull's-eye target system is disclosed. A cylindrical shaft with a flat plate bull's-eye target on one end fits within and is supported on a rigid base by a pair of bushing guide members. A cam member on the shaft is biased against a snap switch, the switch connected to a signal means. A projectile striking the target displaces the target, shaft and cam out of contact with the switch, activating the signal means. The biasing means then returns the cam into contact with the switch, deactivating the signal means.

8 Claims, 1 Drawing Sheet

INSTANT RESPONSE BULL'S -EYE TARGET SYSTEM

FIELD OF THE INVENTION

The instant invention relates generally to a bull's-eye target and more specifically to a target system which provides an instant signal upon a projectile impacting upon the bull's-eye target.

BACKGROUND OF THE INVENTION

Various target inventions have been disclosed in the prior art. These include the resetting targets of Doughty U.S. Pat. No. 4,614,345 and Marquardt U.S. Pat. No. 4,917,388, and the portable target assembly of Wade in U.S. Pat. No. 4,726,593. These references disclose various steel reactive targets with centers called bull's-eye which do not provide the novel improvements of applicants' instant response bull's-eye target system herein disclosed.

Applicants, in co-pending application Ser. No. 08/499,106 filed Jul. 6, 1995, now U.S. Pat. No. 5,533,732, have disclosed a target apparatus which provides a visual signal upon impact by a projectile. The target and a portion of the support frame suspended on a pair of pins pivot on the pin supports when a projectile impacts the target and supporting plate. The pivoting of the suspended portion of the support frame activates the visual signal. The contents of that application are incorporated herein by reference. It is desirable to provide a smaller target than disclosed in this co-pending application to better assess the accuracy of an individual firing at the target.

One objective of the invention is to provide a bull's-eye target system with an instant response with minimal reset time and reset effort. A further objective is to provide a target system that is simple to assemble and use, and is economical to manufacture, including standardized replaceable parts. Another objective is to provide a target which resets without individuals traveling down range, and a system with reduced chance for ricochet after projectile impact. A further objective is to provide a response which can be seen or heard by individuals at some distance from the target system. Further objectives and advantages of the invention will become apparent from a consideration of the FIGURE and description to follow.

SUMMARY OF THE INVENTION

The invention comprises an instant response bull's-eye target system comprising a target support unit including a rigid support frame base with first and second bushing guide members secured to the support frame base. A cylindrical shaft member, with first and second ends, movably fits within and is supported by the bushing guide members on the support frame base. A generally circular flat plate target member is fastened at its center to the first end of the shaft member. A tapered cam member, with larger and smaller ends, encircles the cylindrical shaft member and is oriented with the smaller end nearest the target member. The cam member is secured at about the midpoint of the shaft member between the pair of bushing guide members. A snap switch is attached to the support frame and is positioned to contact the cam member, the switch being in the open position when contacting the cam member. There is biasing means between the cylindrical shaft member and the target support unit, with the biasing means reversibly holding the associated tapered cam member against the snap switch. There is means for signaling the closing of the snap switch.

Operationally, a projectile striking the target member displaces the target and attached cylindrical shaft and associated cam member along the cylindrical axis of the shaft member. The displacement of the shaft moves the associated cam member out of contact with the snap switch, closing the switch, thereby activating the signal means. The biasing means immediately returns the target, cylindrical shaft and associated cam member into contact with the snap switch, opening the switch, thereby deactivating the signal means.

DESCRIPTION OF THE PREFERRED EMBODIMENTS

Figure 1:
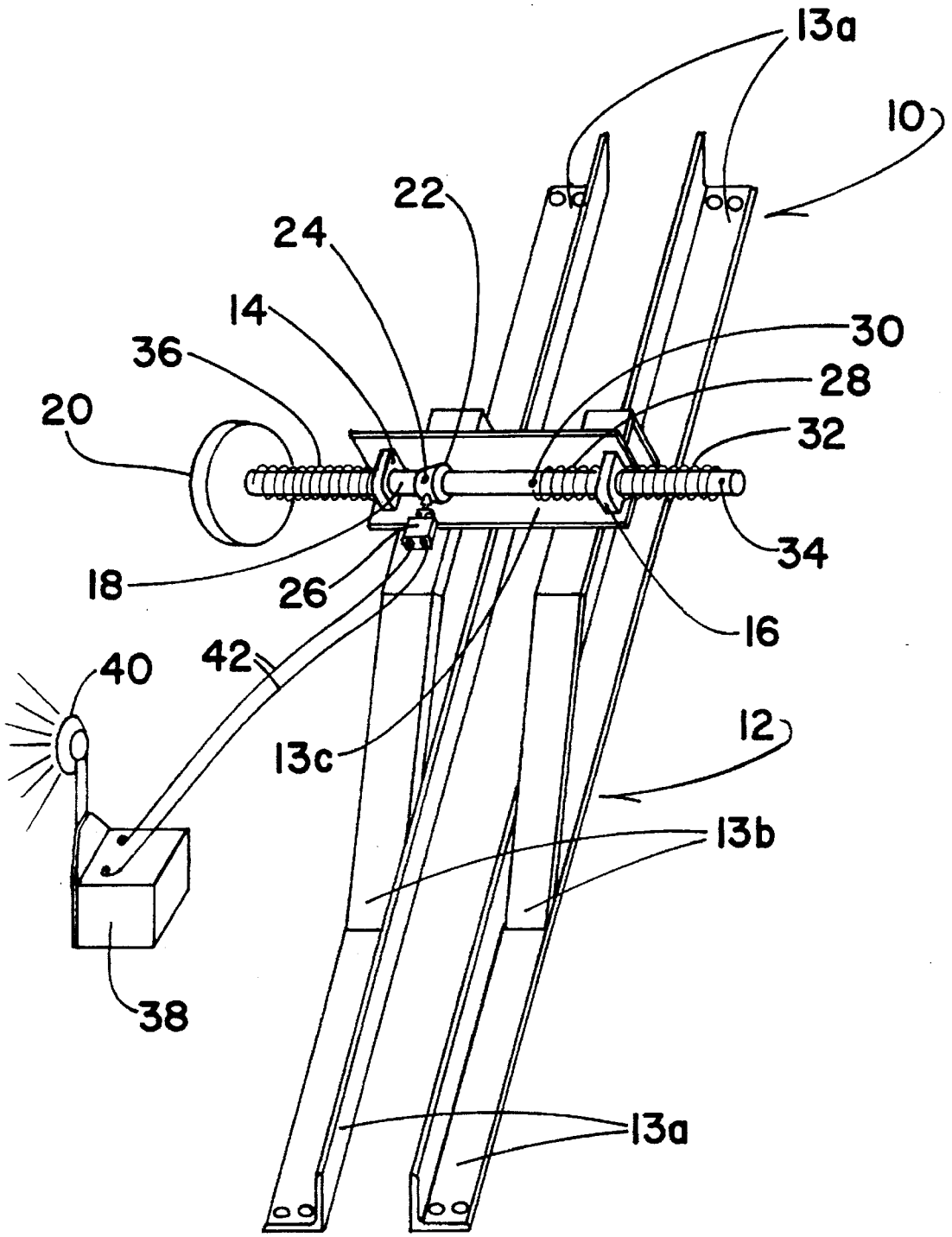
FIG. 1 is an elevation side view of the bull's-eye target system.

Referring to FIG. 1, the bull's-eye target system comprises a target support unit 10 composed of a rigid support frame base 12 with first and second bushing guide members 14 and 16 secured to the support frame base 12, a selected distance apart. The support frame base 12 of FIG. 1 is made up of a pair of parallel support members 13*a*, each with a rectangular riser 13*b*, the risers connected by at least one perpendicular piece of angle iron 13*c*. The bushing members 14 and 16 in this case are secured to the perpendicular angle iron 13*c*, a selected distance apart. Other configurations for the support base are envisioned, the only requirement being that the base be rigid and provide a stable surface for securely fastening the bushing guide members (14 & 16) a selected distance apart.

A cylindrical shaft member 18 with first and second ends fits within and is supported by the pair of bushing guide members 14 and 16. The shaft member 18 is sized to move easily along its cylindrical axis within the supporting bushings. A generally circular flat plate target member 20 is fastened at its center to the first end of said cylindrical shaft. This plate member is the bull's-eye target. A tapered cam member 22 with larger and smaller ends encircles the cylindrical shaft member 18 and is oriented with the smaller end nearer the target member. The cam member 22 is secured at about the midpoint of the shaft member with a roll pin 24, although other methods of fastening the cam member to the shaft are known and can provide a secure fastening together of the two members. The cam member 22 is positioned between the first and second bushing guide members 14 and 16.

A snap switch 26 is attached to the support frame 12 and the switch is positioned to contact the cam member 22, the switch 26 being in the open position when contacting the cam member 22. A biasing means between the cylindrical shaft member 18 and the target support unit 10 reversibly holds the associated tapered cam member 22 against the snap switch 26. The biasing means in FIG. 1 comprises a first or primary return spring 28. The spring 28 is a coil spring which encircles the cylindrical shaft member 18 and is positioned between the larger end of the associated cam member 22 and the bushing guide 16 farthest from the target member 20. A stop means, such as a roll pin 30, inserted into the shaft member 18 contacts the end of the spring 28 closest the cam member 22. The primary return spring 28 is of sufficient length that the spring is under compression, thus holding the cam member 22 in contact with the snap switch 26. Additionally, a second or secondary return spring 32 may also be present. The spring 32 is also a coil spring which encircles the cylindrical shaft member 18 and is positioned between the second bushing guide member 16 and the second end of the shaft, that end farthest from the target member 20. Another stop means, such as a roll pin 34, inserted into an aperture in the shaft member 18 near the second end thereof, retains the secondary return spring 32 on the shaft. The secondary return spring 32 is of sufficient length that the spring is also under slight compression when contacting the bushing guide member 16 and the roll pin 34. The secondary return spring 32 is designed such that it will not overcome the force of the primary return spring 28 biasing the cam member 22 into contact with the snap switch 26.

A projectile striking the target member 20 moves the attached cylindrical shaft 18 and associated cam member 22 along the cylindrical axes of the shaft member. The cam member 22 moves out of contact with the snap switch 26, closing the switch. The movement of the shaft momentarily compresses the primary return spring 28 to a greater extent. The movement also allows the secondary return spring 32 to expand to a greater extent. Then the primary return spring 28 expands back to its original position, pushing the shaft 18 and associated cam member 22 back into contact with the snap switch 26, thus opening the switch. The secondary return spring 32 is simultaneously compressed by the movement of the shaft member 18 to its original position.

Optionally, a longer primary return spring may be used, one which contacts the larger end of the cam member and the support bushing furthest from the target, eliminating the need for the roll pin 30. Other biasing means can be envisioned, such as springs fastened to the shaft member 18 and to the support frame base 12. The coil springs encircling the shaft are the preferred embodiments of the biasing means.

Additionally, a dampening spring 36 may be added to dampen the movement of the target and cylindrical shaft member upon being struck by a projectile. The dampening spring 36 is also a coil spring encircling the shaft member 18 and positioned between the flat target member 10 and the support bushing 14 closest the target member. The dampening spring 36 is slightly shorter in length than the distance from the target member 20 to the support bushing 14 with the cam member 22 held against the snap switch 26. Upon movement of the target member 20 and attached shaft member, the dampening spring 36 contacts both the target 20 and the support bushing 14 and is compressed. The dampening spring 36 responds to the compression by expanding back to its original state, assisting in moving the cam member 22 into contact with the snap switch 26, and thus dampening the movement of the target, shaft and cam member.

In addition, there is a means for signaling the closing of the snap switch 26 which occurs upon movement of the tapered cam member 22 away from the switch. The signaling means shown in FIG. 1 is an electrical power source 38, such as a storage battery or the like, connected to an electrical light bulb 40 through circuit wires 42. The closing of the snap switch 26 completes the electrical circuit which causes the light 40 to be activated. Alternatively, substitution of an electrical bell for the light bulb produces an audible signal. Other signal means include an electrically activated mechanical flag or similar device to signal movement of the target member.

In operation, a projectile striking the target member 20 displaces the target and attached cylindrical shaft 18 and associated cam member 22 along the cylindrical axis of the shaft member. The displacement of the shaft member moves the associated cam member 22 out of contact with the snap switch 26, closing the switch and activating the signal means, in the case of FIG. 1, the power source 38 and electrical light bulb 40. The biasing means, such as the primary return spring 28 and the secondary return spring 32, immediately returns the target, cylindrical shaft and associated cam member 22 into contact with the snap switch 26, opening the switch, and thus deactivating the signal means, the light bulb. The taper of the cam member 22 allows for a smooth release from contact with the snap switch 26, as well as a smooth contact when the cam member returns to the starting position. The target member 20 is sufficiently large that it protects the bushing members, the shaft member and the associated cam member, the primary and secondary return springs, the dampening spring, and the snap switch from damage by a projectile. Any projectile failing to strike the target member 20 will fail to strike these components of the system as well.

The instant response bull's-eye target system is particularly well suited to be used in conjunction with applicants' previously disclosed instant response target system, pending U.S. application Ser. No. 08/499,106 filed Jul. 6, 1995. The target support unit of the present invention is mounted behind the larger target member disclosed in the previous application, with an aperture located in the center of the larger target member. The cylindrical shaft member extends from behind the larger target, through the aperture, supporting the bull's-eye at the center of the larger target member. The larger target member and the smaller bull's-eye target member employ separate and distinct signal means to clearly indicate if a projectile strikes the larger target member or the smaller bull's-eye member.

While the above description contains certain features, these should not be construed as limitations on the scope of the invention, but rather as one description. It will be understood that various omissions, changes, and substitutions in the forms and details of the device and in its operation can be made by those skilled in this field without departing from the spirit of the invention.

We claim:

1. An instant response bull's-eye target system comprising;

a) a target support unit comprising a rigid support frame base with first and second bushing guide members secured to said support frame base a selected distance apart;

b) a cylindrical shaft member with first and second ends, said shaft member fitting and movable within and supported by said bushing guide members on said support frame base;

c) a generally circular flat plate target member fastened at its center to the first end of said shaft member;

d) a tapered cam member with larger and smaller ends, said cam member encircling said cylindrical shaft member and oriented with the smaller end nearest said target member, said cam member secured at about the midpoint of said shaft member, said cam member positioned between said first and second bushing guide members;

e) a snap switch attached to said support frame and positioned to contact said cam member, said switch being in the open position when contacting said cam member;

f) biasing means between said cylindrical shaft member and said target support unit, said biasing means reversibly holding said associated tapered cam member against said snap switch; and g) means for signaling closing of said snap switch, whereby a projectile striking said target member displaces said target and attached cylindrical shaft and associated cam member along the cylindrical axis of the shaft member, the displacement of the shaft moving the associated cam member out of contact with said snap switch, closing said switch, thereby activating said signal means, and whereby said biasing means returns said target, cylindrical shaft and associated cam member into contact with said snap switch, opening said switch, thereby deactivating said signal means.

2. A target system according to claim 1 wherein said biasing means comprises a first coil spring encircling said shaft member and positioned between said tapered cam member and said bushing support member furthest from said target member and a second coil spring encircling said shaft member and positioned between said bushing support member furthest from said target member and a roll pin positioned in a aperture near the second end of said shaft member.

3. A target system according to claim 2 further comprising a roll pin fastened into an aperture in said cylindrical shaft member at a point between said cam member and said bushing member furthest from said target member.

4. A target system according to claim 1 wherein said signaling means comprises an electrical power source connected in a wire circuit including an electric light bulb, said wire circuit connected to said snap switch.

5. A target system according to claim 1 wherein said signaling means comprises an electrical power source connected in a wire circuit including an electric activated bell, said wire circuit connected to said snap switch.

6. A target system according to claim 1 further comprising a dampening coil spring member encircling said cylindrical shaft member, said spring positioned between said target member and said first bushing guide member.

7. An instant response bull's-eye target system comprising;

a) a target support unit comprising a rigid support frame base with first and second bushing guide members secured to said support frame base a selected distance apart;

b) a cylindrical shaft member with first and second ends, said shaft member fitting and movable within and supported by said bushing guide members on said support frame base;

c) a generally circular flat plate target member fastened at its center to the first end of said shaft member;

d) a tapered cam member with larger and smaller ends, said cam member encircling said cylindrical shaft member and oriented with the smaller end nearest said target member, said cam member secured at about the midpoint of said shaft member said cam member positioned between said first and second bushing guide members;

e) a snap switch attached to said support frame and positioned to contact said cam member, said switch being in the open position when contacting said cam member;

f) a primary and a secondary return coil spring, each encircling said cylindrical shaft member, said primary return spring positioned between said tapered cam member and said bushing support member farthest from said target member, said secondary return spring positioned between said bushing support member furthest from said target member and a roll pin inserted into an aperture near the second of said shaft member, said primary and secondary return coil springs reversibly holding said associated tapered cam member against said snap switch; and g) an electrical power source connected in a wire circuit including an electric light bulb, said wire circuit connected to said snap switch, whereby a projectile striking said target member displaces said target and attached cylindrical shaft and associated cam member along the cylindrical axis of the shaft member, the displacement of the shaft moving the associated cam member out of contact with said snap switch, closing said switch, thereby activating said electrical light bulb, and whereby said primary and secondary return coil springs return said target, cylindrical shaft and associated cam member into contact with said snap switch, opening said switch, thereby deactivating said electrical light bulb.

8. A target system according to claim 2 further comprising a dampening coil spring member encircling said cylindrical shaft member, said spring positioned between said target member and said first bushing guide member.

* * * * *